US006746320B2

(12) United States Patent
Krusell et al.

(10) Patent No.: US 6,746,320 B2
(45) Date of Patent: Jun. 8, 2004

(54) LINEAR RECIPROCATING DISPOSABLE BELT POLISHING METHOD AND APPARATUS

(75) Inventors: Wilbur Krusell, Incline Village, NV (US); Glenn Travis, Sunnyvale, CA (US); Erik Engdahl, Livermore, CA (US); James Bagley, Lakeway, TX (US)

(73) Assignee: Lam Research Corporation, Fremont, CA (US)

( * ) Notice: Subject to any disclaimer, the term of this patent is extended or adjusted under 35 U.S.C. 154(b) by 43 days.

(21) Appl. No.: 10/136,600

(22) Filed: Apr. 30, 2002

(65) Prior Publication Data

US 2002/0123298 A1 Sep. 5, 2002

Related U.S. Application Data

(62) Division of application No. 09/607,727, filed on Jun. 30, 2000.

(51) Int. Cl.[7] ..... B24B 21/00

(52) U.S. Cl. ..... 451/302; 451/304; 451/311; 451/307; 451/5; 451/168

(58) Field of Search ..... 451/302, 304, 451/311, 307, 5, 168, 59, 164, 297

(56) References Cited

U.S. PATENT DOCUMENTS

| | | | | |
|---|---|---|---|---|
| 3,753,269 A | 8/1973 | Budman | | 15/160 |
| 4,318,250 A | 3/1982 | Klievoneit et al. | | 51/134 |
| 4,416,090 A | 11/1983 | Jonasson | | 51/138 |
| 4,672,985 A | 6/1987 | Mohr | | 134/57 |
| 4,720,939 A | 1/1988 | Simpson et al. | | 427/58 |
| 4,934,102 A | 6/1990 | Leach et al. | | 51/50 |
| 5,081,051 A | 1/1992 | Mattingly et al. | | 437/10 |
| 5,335,453 A | 8/1994 | Baldy et al. | | 51/67 |
| 5,399,125 A | 3/1995 | Dozier | | 474/117 |
| 5,484,323 A | 1/1996 | Smith | | 451/10 |

(List continued on next page.)

FOREIGN PATENT DOCUMENTS

| | | |
|---|---|---|
| EP | 1031398 | 8/2000 |
| JP | 4-250967 | 9/1992 |
| WO | WO 98/45090 | 10/1998 |
| WO | WO 99/22908 | 5/1999 |

OTHER PUBLICATIONS

U.S. patent application Ser. No. 09/540,810 Fixed Abrasive Linear Polishing Belt And System—Inventors: Zhao et al. Filing Date: Mar. 31, 2000 Attorney Docket No. 7103–135.

U.S. patent application Ser. No. 09/541,144 Method And Apparatus For Chemical Mechanical Planarization and Polishing Of Semiconductor Wafers Using A Continuous Polishing Member Feed—Inventors: Mooring et al., Filing Date: Mar. 31, 2000 Attorney Docket No. 7103/165.

European Patent Office Patent Abstract of Japan, Publication No. JP2269553 dated Feb. 11, 1990, entitled "Polishing Method And Device Thereof".

*Primary Examiner*—Joseph J. Hail, III
*Assistant Examiner*—Alvin J Grant
(74) *Attorney, Agent, or Firm*—Brinks Hofer Gilson & Lione

(57) ABSTRACT

An apparatus for chemically mechanically planarizing a semiconductor wafer is disclosed having a continuous polishing strip with first side having a fixed abrasive surface and a second side opposite the first side. In one embodiment, a first drive roller holds a first end of the polishing strip, a second drive roller holds a second end of the polishing strip, and a pair of support rollers contacts the second side of the polishing strip on either end of a polishing strip support. A drive motor is operably connected to the first and second drive rollers for moving the polishing strip in a linear, bi-directional manner.

6 Claims, 4 Drawing Sheets

U.S. PATENT DOCUMENTS 5,536,202 A 7/1996 Appel et al. ..... 451/285
5,547,417 A 8/1996 Breivogel et al. ..... 451/58
5,558,568 A 9/1996 Talieh et al. ..... 451/303
5,575,707 A 11/1996 Talieh et al. ..... 451/384
5,578,362 A 11/1996 Reinhardt et al. ..... 428/147
5,593,344 A 1/1997 Weldon et al. ..... 451/296
5,611,943 A 3/1997 Cadien et al. ..... 216/88
5,622,526 A 4/1997 Phillips ..... 451/72
5,643,044 A * 7/1997 Lund ..... 451/5
5,655,951 A 8/1997 Meikle et al. ..... 451/56
5,692,947 A 12/1997 Talieh et al. ..... 451/41
5,692,950 A 12/1997 Rutherford et al. ..... 451/552
5,759,918 A 6/1998 Hoshizaki et al. ..... 438/692
5,762,536 A 6/1998 Pant et al. ..... 451/6
5,810,964 A 9/1998 Shiraishi ..... 156/345
5,871,390 A 2/1999 Pant et al. ..... 451/5
5,885,143 A 3/1999 Ichikawa et al.
5,897,426 A 4/1999 Somekh ..... 451/41
5,899,798 A 5/1999 Trojan et al. ..... 451/259
5,908,530 A 6/1999 Hoshizaki et al. ..... 153/345
5,913,716 A 6/1999 Mucci et al.
5,958,794 A 9/1999 Bruxvoort et al. ..... 438/692
6,001,004 A 12/1999 Botteghi
6,068,542 A 5/2000 Hosokai
6,110,025 A 8/2000 Williams et al. ..... 451/41
6,179,709 B1 1/2001 Redeker et al.
6,196,898 B1 3/2001 Sommer ..... 451/5
6,231,427 B1 5/2001 Talieh et al. ..... 451/41
6,261,163 B1 7/2001 Walker et al.
6,261,959 B1 * 7/2001 Travis et al. ..... 438/692
6,283,838 B1 * 9/2001 Blake et al. ..... 451/63
6,296,557 B1 * 10/2001 Walker ..... 451/526
6,361,411 B1 * 3/2002 Chopra et al. ..... 451/56
6,428,394 B1 * 8/2002 Mooring et al. ..... 451/41
6,491,570 B1 * 12/2002 Sommer et al. ..... 451/41

* cited by examiner

LINEAR RECIPROCATING DISPOSABLE BELT POLISHING METHOD AND APPARATUS

RELATED APPLICATIONS

The present application is a divisional application of U.S. application Ser. No. 09/607,727, filed Jun. 30, 2000, which is incorporated by reference in its entirety herein.

FIELD OF THE INVENTION

The present invention relates to polishing and planarization of semi-conductor wafers. More particularly, the present invention relates to a method and apparatus for linearly reciprocating at least a portion of a continuous polishing member to polish a semiconductor wafer.

BACKGROUND

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive toward smaller, more highly integrated circuit designs. Semiconductor wafers are also commonly constructed in layers, where a portion of a circuit is created on a first level and conductive vias are made to connect up to the next level of the circuit. After each layer of the circuit is etched on the wafer, an oxide layer is put down allowing the vias to pass through but covering the rest of the previous circuit level. Each layer of the circuit can create or add unevenness to the wafer. This unevenness is preferably smoothed out before generating the next circuit layer.

Chemical mechanical planarization (CMP) techniques are used to planarize the raw wafer and each layer of material added thereafter. Available CMP systems, commonly called wafer polishers, often use a rotating wafer holder that brings the wafer into contact with a non-abrasive polishing pad moving in the plane of the wafer surface to be planarized. A polishing fluid, such as a chemical polishing agent or slurry containing microabrasives, is applied to the polishing pad to polish the wafer. The wafer holder then presses the wafer against the rotating polishing pad and is rotated to polish and planarize the wafer. Another type of polisher is a linear polishing mechanism that rotates a polishing pad mounted on an endless loop. This type of polisher also utilizes an abrasive slurry to chemically-mechanically planarize or polish semiconductor wafers. With the recent introduction of fixed abrasive polishing media that does not require an abrasive slurry in order to planarize or polish a semiconductor wafer, new wafer polishers are desirable that can take advantage of the fixed abrasive media.

DETAILED DESCRIPTION OF THE PRESENTLY PREFERRED EMBODIMENTS

Figure 1:
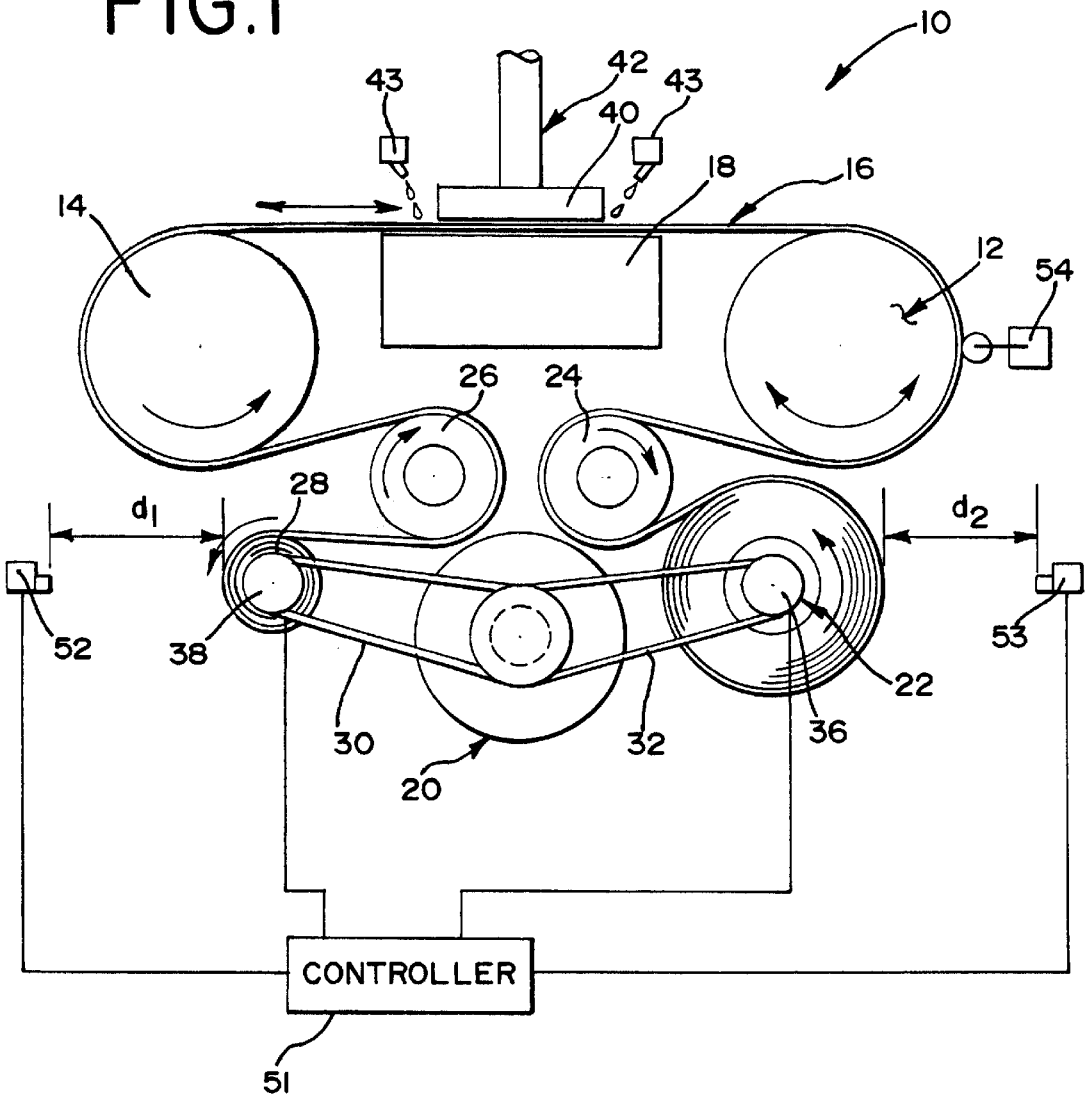
FIG. 1 is an elevational side view of a semiconductor wafer polishing device according to a preferred embodiment.

In order to address the need for wafer polishers that are suitable for use with fixed abrasive polishing media, a wafer polisher is disclosed below that provides an apparatus and method for applying fixed abrasive polishing media to linear polishing techniques. A preferred embodiment of the wafer polisher 10 is illustrated in FIG. 1. The polisher 10 includes a pair of belt support rollers 12, 14 used to control vertical position of a polishing strip 16. Positioned between the first and second support rollers is a polishing strip support 18. Preferably, the polishing strip is oscillated by a drive assembly made up of a central drive motor 20 connected to a pair of drive rollers 22, 28 through a belt pulley system. The drive rollers may be driven by any of a number of known types of DC servo motors.

The first drive roller 22 holds a supply of unused polishing strip material that is wound, in a continuous strip, around a portion of the circumference of the first idler roller 24, looped around the first belt support roller 12, passed over the support platen 18, and around the second support roller 14. The polishing strip continues from the second support roller 14 around a portion of the circumference of the second idler roller 26 and is held at a second end by a take-up roller 28. The take-up and feed rollers are preferably actively driven by the drive motor 20 through a pulley system. As shown in FIG. 1, the pulley system may include a plurality of belts 30, 32 interconnecting the drive motor 20 to the first and second drive rollers 22, 28. In other embodiments, chains, gears or other methods of transferring movement between the motor and rollers may be used. Tension on the polishing strip 16 is maintained by the first and second drive rollers 22, 28. Preferably, the tension is maintained on these rollers using slip clutches 36, 38 mounted on the first and second drive rollers 22, 28.

The preferred embodiment, distance measuring devices 52, 53 constantly monitor the diameter of the drive rollers 22, 28 to sense the change in diameter based on taking up or feeding out polishing strip material during operation. The distance measuring devices 52, 53 monitor a distance $d_1$, $d_2$ between the distance measuring device 52, 53 and the respective drive roller 28, 22. The distance data is then feed to a CPU-based controller configured to calculate the appropriate torque that is necessary at each of the slip clutches. The torque information is provided to the proper slip clutch, for example in the form of a voltage. Using the voltage signal from the controller 51, the slip clutches 36, 38 maintain a torque proportionate to the change in torque moment arm resulting from drive roller diameter changes due to taking up or feeding out polishing strip material. By slipping at the required torque value, the slip clutches thus maintain the pre-established tension on the belt at all times. In one embodiment, the distance measuring device may be a laser-type, or other optical format, distance measuring device and the particle slip clutches may be magnetic. The controller 51 may have any one of a number of commonly available CPUs and memory for maintaining logic suitable for calculating torque values necessary to maintain a desired tension based on the measured diameter changes, and subsequently generate the appropriate voltage with, for example, standard digital-to-analog converter circuitry.

The drive motor 20 is preferably a bi-directional drive motor adjustable to linearly reciprocate a length of the polishing strip through the polishing area. The polishing area is defined by the area of polishing strip positioned between the support 18 and the wafer (not shown) held by a wafer carrier 40 that is pressed against the strip 16 by a spindle assembly 42. In a preferred embodiment the length of polishing strip driven through the polishing area is adjustable from any desired incremental length to substantially the entire length of the strip. The number of oscillations of the polishing strip through the polishing area, per wafer treated, is selectable. While the polisher 10 may be adjusted to move the polishing member at various frequencies, the frequency of oscillation is preferably within the range of 0–25 Hertz.

The polishing strip 16 preferably has a width greater than the width of the wafer to be polished. Preferably the polishing strip is a consumable that may be constructed of any of a number of fixed abrasive materials suitable for use in planarization and/or polishing of semiconductor wafers. For example, the structured abrasive belts available under part numbers 3M 307EA or 3M 237AA from 3M Corporation of St. Paul, Minn. are suitable for this purpose. The polishing strip support 18 may be a platen producing a fluid bearing such as the platen used with the TERES™ polisher available from Lam Research Corporation of Fremont, Calif., or the wafer support assembly disclosed in U.S. Pat. No. 5,558,568, the entire disclosure of which is incorporated herein by reference. The slip clutches may be any of a number of available types of magnetic particle adjustable torque slip clutches. The support rollers may be hollow or solid cylinders preferably having a width greater than the width of the polishing strip. The support and idler rollers may be actively driven or passively rotatable by the polishing strip as it passes over the rollers. As described above, the slip clutches 36, 38 on the first and second drive rollers preferably maintain a constant belt tension and allow for rotational speed changes as polishing strip accumulates onto or feeds off of the rollers.

Using the polisher 10 of FIG. 1, a semiconductor wafer may be polished and/or planarized by lowering the wafer against the strip of fixed abrasive with the spindle assembly and wafer carrier. The strip may be set in motion prior to or shortly after the wafer contacts the strip. In a first embodiment, the drive motor 20 rotationally reciprocates such that the drive rollers 22, 28 move the polishing strip back and forth at a desired oscillation rate. In an alternative embodiment, the drive motor 20 may be adjusted to oscillate such that substantially the entire length of the polishing strip is passed across the platen 18 each oscillation back and forth. In either instance, the wafer holder 40 and spindle assembly 42 preferably rotate the wafer while pressing the wafer against the linearly moving polishing strip.

In one embodiment, the polisher 10 may be operated to linearly oscillate a selected length of the polishing strip against the surface of a wafer and incrementally introduce new portions of the polishing strip by operating the drive rollers to steadily move the polishing strip more in one direction than the other with each oscillation. Alternatively, the polisher may be operated to treat each wafer with a different set amount of the polishing strip. In other embodiments, the polisher may use the same set amount of polishing strip for each of a group of wafers before moving a different portion of polishing strip into the polishing area for treatment of another group of wafers. Although not required, each of the embodiments described herein may utilize a non-abrasive liquid during polishing, such as deionized water, to facilitate the polishing process. The non-abrasive liquid may be applied via nozzles 43 (See FIG. 1) to the region of the polishing strip intended for contact with a wafer. In another embodiment, a pad conditioner 54 may be used to prepare the polishing strip for use. For example, if a protective coating, such as a polymer film, need to be removed from the polishing strip, the pad conditioner may be used to engage the appropriate portion of the polishing member to remove the protective coating. Any of a number of commercially available polishing pad conditioners may be used, including rotary disks and cylindrical rollers. The pad conditioner may be withdrawn from contact with the polishing strip after removal of any protective film.

Figure 2:
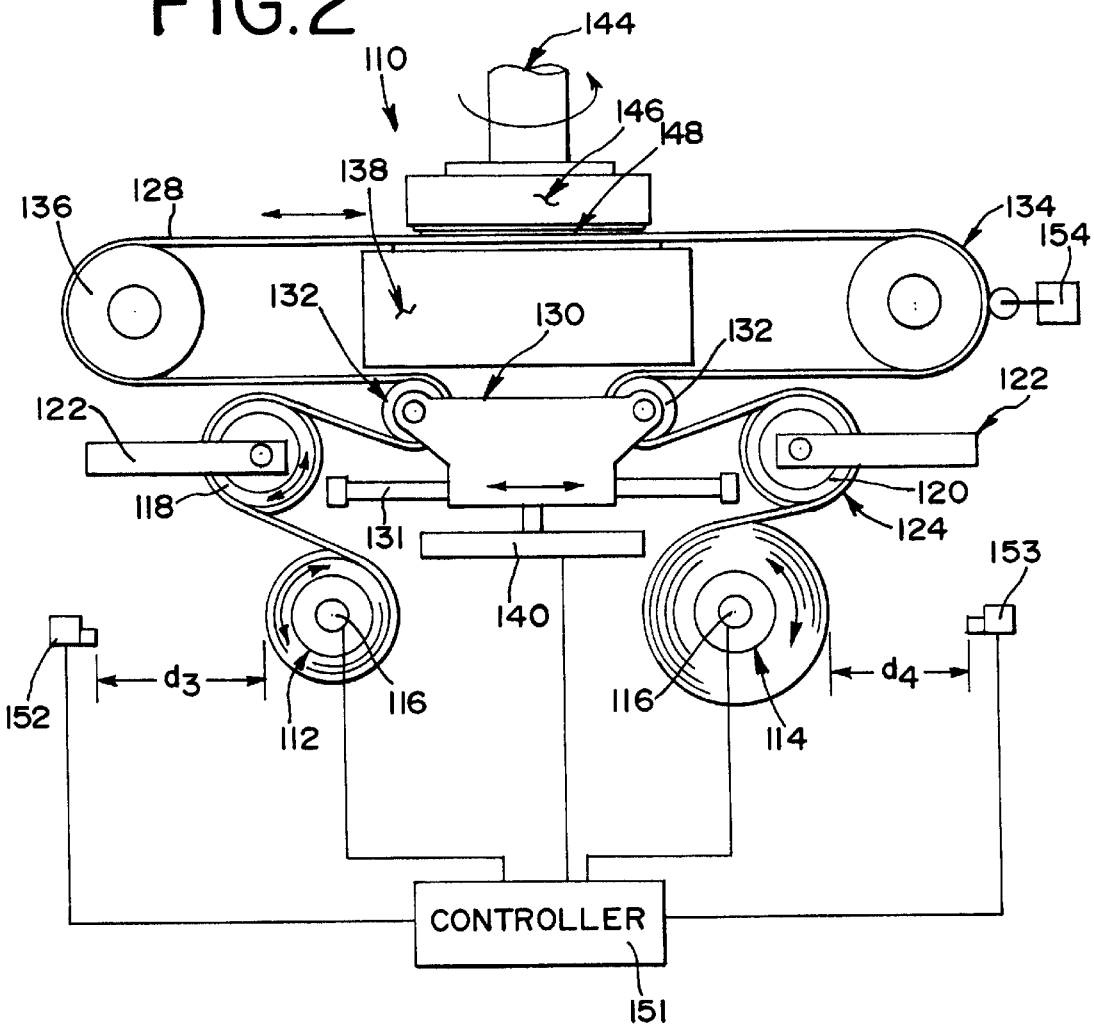
FIG. 2 is an elevational side view of the second embodiment of a preferred semiconductor wafer polishing device according to the present invention.
Figure 2A:
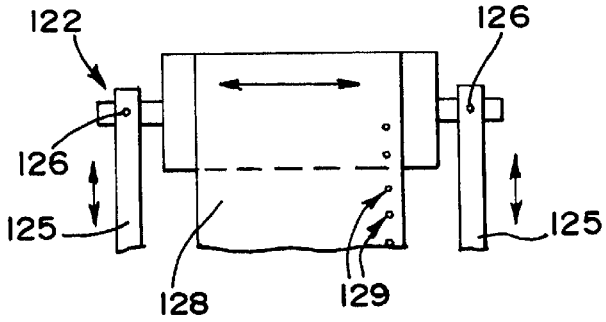
FIG. 2A is a top sectional view of a drive roller used in the wafer polishing device of FIG. 2.

Referring to FIG. 2, a second embodiment of the present invention is disclosed. The wafer polisher 110 of FIG. 2 also includes a take-up roller and a feed roller, 112, 114. Each of the take-up and feed rollers preferably include a clutch, such as commonly available variable torque, magnetic particle clutches with internal roller motor 116. A respective one of a pair of drive rollers 118, 120 is mounted on a belt tracking device 122 and is positioned adjacent each of the take-up and feed rollers. Preferably, the drive rollers are covered with a high friction surface 124, such as hypolon and also include internal drive motors. FIG. 2A illustrates the belt tracking device 122 in more detail. In one embodiment, the belt tracking device may use an optical detector to determine if the polishing strip 128 is moving laterally along the width of the drive roller and/or to determine the velocity of the strip. The polishing strip 128 may have a plurality of reference indicators 129, such as marks or holes, that the belt tracking device 122 may use to monitor polishing strip motion and position. Pivot arms 125 may be manipulated to tilt the drive rollers 118, 120 about pivot points 126 to compensate for the lateral strip movement.

A programmable reciprocating linear actuator equipped with a roller carriage 130 and having a pair of carriage mounted idler rollers 132 is positioned adjacent the drive rollers 118, 120. The programmable actuator 140 and roller carriage 130 is operably movable in a linear direction parallel to the longitudinal direction of the polishing strip 128. As with the embodiment of FIG. 1, a pair of belt support rollers 134, 136 are positioned on the side of a support platen 138 to maintain the height of the strip passing through the polishing area and avoid access wear of the strip against the support 138. The polisher 110 applies a linear reciprocating motion to the polishing strip through linear motion of the programmable reciprocating linear actuator and roller carriage along the linear shaft 131.

In order to maintain a constant tension on the polishing strip, the slip clutch in each of the take-up and feed rollers 112, 114 is adjusted by a controller 151 based on diameter measurements made with distance measuring devices 152, 153. Suitable controllers 151, distance measuring devices 152, 153 and slip clutches are described with respect to the embodiment of FIG. 1. Also, as described in the embodiment of FIG. 1, a pad conditioner 154 may be used to remove any protective film on the polishing strip prior to planarizing semiconductor wafers.

Utilizing the polisher 110 of FIGS. 2 and 2A, a method of polishing a semiconductor wafer is described below. Preferably, a first supply of the polishing strip 128 is positioned in the polishing area (i.e. the area of the polishing strip over, or adjacent to, the support platen 138) and the take-up and feed rollers lock in position using the magnetic particle clutches. Once the take-up and feed rollers have been locked in their positions, the programmable reciprocating roller carriage is linearly reciprocated along the shaft to provide a linear motion of the strip against the wafer. As described above with respect to FIG. 1, a spindle drive assembly 144 and wafer carrier 146 cooperate to press the wafer 148 against the strip and rotate the wafer. Tension and friction are used to prevent slippage of the polishing strip on the oscillating carriage rollers 132. In an alternative embodiment, a clamping device may be used at each carriage roller 132 to hold the polishing strip and ensure that only a discrete portion of the polishing strip is used for any given series of oscillations.

Figure 3:
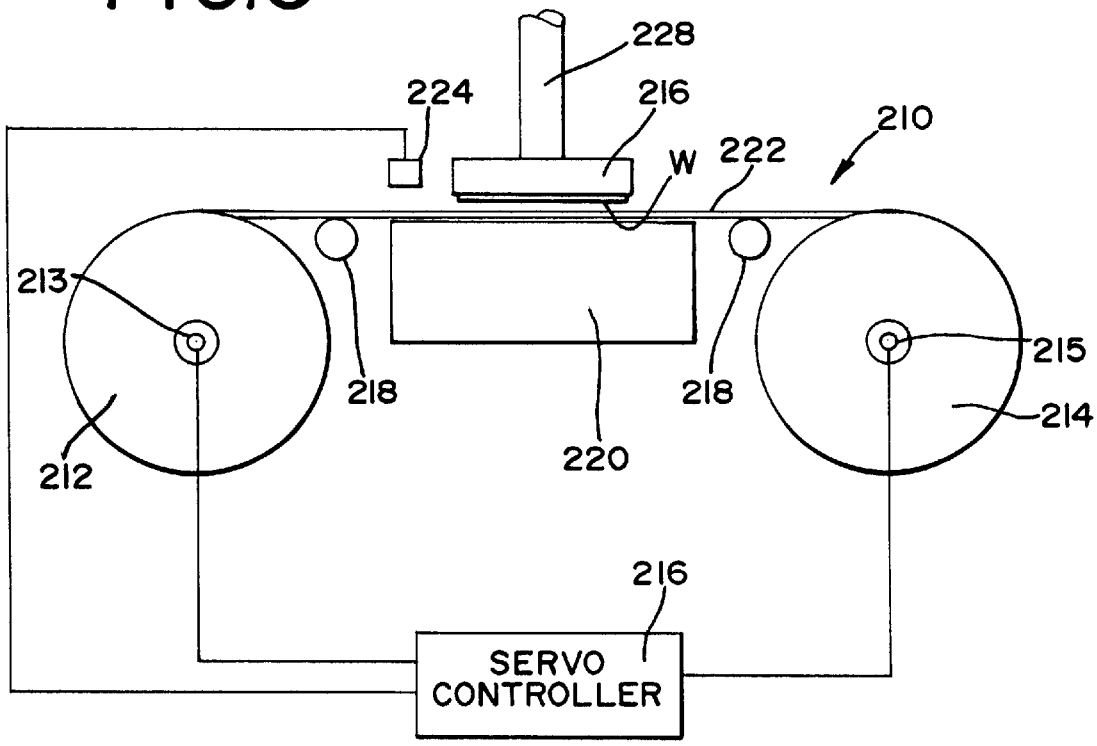
FIG. 3 is an elevational side view of a third embodiment of a semiconductor wafer polishing device.
Figure 3A:
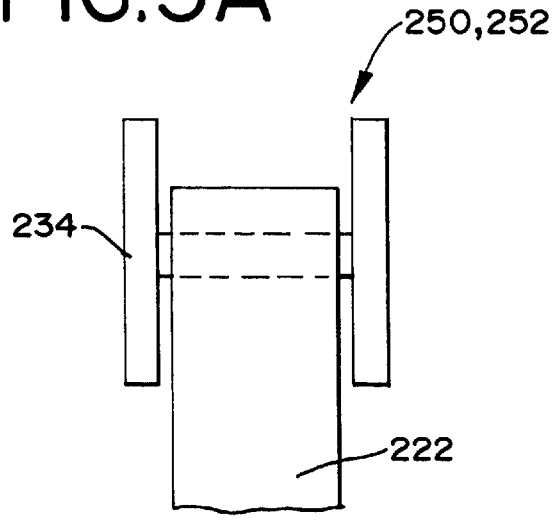
FIG. 3A is a top sectional view of a roller suitable for use in the wafer polishing device of FIG. 3.

A third embodiment of the present invention is best shown in FIG. 3. In this embodiment, the feed 212 and take-up 214 rollers of the polisher 210 oscillate under the control of a synchronized closed-loop servo controller 216 that maintains a desired belt tension and adjusts roller velocity based on optically, or other type of, measured movement of the polishing strip. Each roller preferably includes an internal roller motor 213, 215. A pair of idle rollers 218 are positioned on either side of the polishing strip support 220 to maintain a fixed elevation of the polishing strip with respect to the polishing plane. The polishing strip support 220 may be the same type of platen assembly as described above. Standard preprogrammed algorithms or an index mark sensing system may be used to control the speed of rotation of the take-up and feed rollers to account for diameter variations as the consumable polishing strip material transfers from the feed roller 212 to the take-up roller 214. Tension is preferably maintained through adjusting motor current for each roller motor with. The take-up and feed rollers may be hollow or solid cylinders used grip the extreme ends of the polishing strip and allow the polishing strip to roll of unroll as polishing proceeds. Alternatively, as shown in FIG. 3A, the take-up or feed roller 250, 252 may be constructed in the shape of a spool with flanges 254 so as to assist with alignment of the polishing strip on each roller.

To aid in tracking and monitoring, the edges of the polishing strip 222 may be smooth, textured, or patterned. The edges may contain holes or other physical features that serve a functional purpose, such as aiding in alignment and tracking of the belt in use or such as aiding in triggering or counting. The edges of the polishing strip and any related features may be formed during molding or may be created in a secondary manufacturing operation such as cutting, drilling, lathing or punching. An optical sensor 224 may be connected to the servo controller 220 to sense polishing strip movement and provide feedback information usable to adjust the velocity of the polishing strip or alignment on the rollers 212, 214. The polishing strip 222 may also have holes cut in it to expose a portion of the wafer W held by the wafer carrier 226 and spindle assembly 228 during polishing. Operation of the embodiment of FIG. 3 may proceed as described with respect to the embodiment of FIG. 1. Additionally, distance measuring devices may monitor roller diameter of the feed and take-up rollers 212, 214, and a pad conditioner may be used, as described in the embodiment of FIG. 1.

Figure 4:
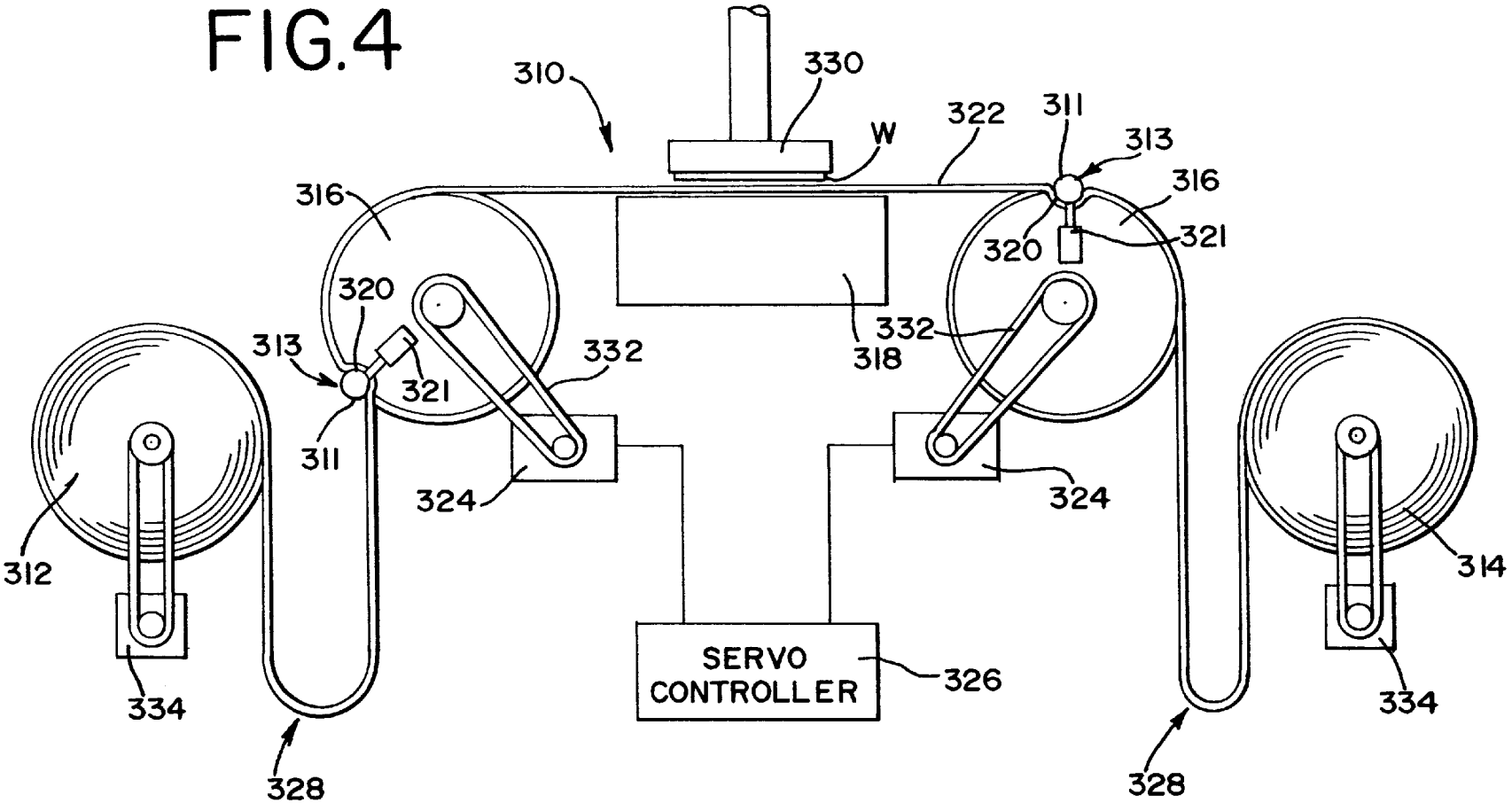
FIG. 4 is an elevational side view of a fourth embodiment of a semiconductor wafer polishing device.

A fourth embodiment of the wafer polisher 310 is disclosed in FIG. 4. In this embodiment, a belt clamping mechanism 313 is attached to each of a pair of drive rollers 316 positioned adjacent opposite sides of a polishing strip support 318. The clamp attachment points 320 on each of the drive rollers 316 are preferably positioned past the top of each drive roller 316 in a direction away from the wafer polishing area defined by the region of polishing strip 322 over the polishing strip support 318. The clamping mechanism 313 may include a clamping member 311, such as a bar extending the width of the roller, that is movable into and out of engagement with the clamp attachment point 320 by a clamp driver 321. The clamp attachment point may be a recessed region having a shape complementary to that of the clamping member on each of the rollers 316. The clamp driver 321 may be any of a number of devices, such as pneumatic or hydraulic pistons and cylinders, an electrically driven motor or drive screw, or other known mechanisms.

A take-up roller 312 and a feed roller 314 are positioned adjacent a respective one of the drive rollers 316. The take-up and feed rollers are preferably actively driven and controllable to maintain a desired slack region 328 of the polishing member 322 so that the take-up and feed rollers may remain substantially stationary while the drive rollers 316 move to polish a wafer W held on a wafer holder 330. This reduces the possibility of stressing the polishing member and reduces the amount of roller mass that must be oscillated during polishing.

The motors 324 driving the drive rollers 316, preferably synchronized DC servo motors controlled by a standard servo controller 326 such as described with respect to FIG. 3, are controlled so that a tension is maintained on the portion of the polishing strip extending between the attachment points and so that the attachment points do not pass below the polishing plane as the polishing member is oscillated against a wafer. The positioning of the attachment points allows oscillation with motion control and avoids the problem of an attachment point 320 passing below the polishing plane during operation. The take-up and feed rollers 312, 314 are preferably only driven between polishing steps to draw a new portion of the polishing strip across the polishing region when the clamps 313 are released and the wafer holder is not pressing and turning a wafer W against the polishing strip. Although shown as connected to the drive rollers by belts 332, the motors may be direct drive motors, internal or external, connected to the axis of rotation of each drive roller 316. The take-up and feed rollers are preferably connected to motors 334 selectively operable to rotate the take-up and feed rollers and move a different portion of the polishing strip over the drive rollers.

It is intended that the foregoing detailed description be regarded as illustrative rather than limiting, and that it be understood that the following claims, including all equivalents, are intended to define the scope of this invention.

We claim:

1. An apparatus for chemically mechanically polishing a semiconductor wafer, the apparatus comprising:

a continuous polishing strip comprising a fixed abrasive surface;

a feed roller for holding an unused portion of the continuous polishing strip;

a take-up roller for holding a used portion of the continuous polishing strip;

a polishing strip support disposed between a pair of polishing strip support rollers; and a pair of drive rollers positioned adjacent opposite ends of a polishing region and between the feed and take-up rollers, the drive rollers each comprising polishing strip clamping regions having clamps for releasably clamping a portion of the polishing strip to the drive rollers, wherein the drive rollers are configured to oscillate a length of the polishing strip across the polishing region.

2. An apparatus for chemically mechanically polishing a semiconductor wafer, the apparatus comprising:

a continuous polishing strip comprising a fixed abrasive surface;

a feed roller for holding an unused portion of the continuous polishing strip;

a take-up roller for holding a used portion of the continuous polishing strip;

a polishing strip support disposed between a pair of polishing strip support rollers; and a pair of drive rollers positioned adjacent opposite ends of a polishing region and between the feed and take-up rollers, the drive rollers each comprising polishing strip clamping regions having clamps for releasably clamping a portion of the polishing strip to the drive rollers, wherein the drive rollers are configured to oscillate a length of the polishing strip across the polishing region, and wherein each of the drive rollers is operably connected with a different drive motor.

3. The apparatus of claim 2, wherein each of the different drive motors is in communication with a servo controller configured to synchronously reciprocate the drive rollers.

4. An apparatus for chemically mechanically polishing a semiconductor wafer, the apparatus comprising:

a continuous polishing strip comprising a fixed abrasive surface;

a feed roller for holding an unused portion of the continuous polishing strip;

a take-up roller for holding a used portion of the continuous polishing strip;

a polishing strip support disposed between a pair of polishing strip support rollers; and a pair of drive rollers positioned adjacent opposite ends of a polishing region and between the feed and take-up rollers, the drive rollers each comprising polishing strip clamping regions having clamps for releasably clamping a portion of the polishing strip to the drive rollers, wherein the drive rollers are configured to oscillate a length of the polishing strip across the polishing region, and wherein the clamps on each of the drive rollers comprise a movable clamping member and a clamp attachment point designed to cooperate with the movable clamping member to maintain a first portion of the polishing strip on a first of the pair of drive rollers and a second portion of the polishing strip on a second of the pair of drive rollers.

5. An apparatus for chemically mechanically polishing a semiconductor wafer, the apparatus comprising:

a continuous polishing strip comprising a fixed abrasive surface;

a feed roller for holding an unused portion of the continuous polishing strip;

a take-up roller for holding a used portion of the continuous polishing strip;

a polishing strip support disposed between a pair of polishing strip support rollers; and a pair of drive rollers positioned adjacent opposite ends of a polishing region and between the feed and take-up rollers, the drive rollers each comprising polishing strip clamping regions having clamps for releasably clamping a portion of the polishing strip to the drive rollers, wherein the drive rollers are configured to oscillate a length of the polishing strip across the polishing region, and wherein the polishing member defines a first region of slack between the take-up roller and a first one of the pair of drive rollers, a second region of slack between the feed roller and a second one of the pair of drive rollers, and the polishing region is defined by a length of polishing strip maintained under a tension between the pair of drive rollers.

6. An apparatus for chemically mechanically polishing a semiconductor wafer, the apparatus comprising:

a continuous polishing strip comprising a fixed abrasive surface;

a feed roller for holding an unused portion of the continuous polishing strip;

a take-up roller for holding a used portion of the continuous polishing strip;

a polishing strip support disposed between a pair of polishing strip support rollers; and a pair of drive rollers positioned adjacent opposite ends of a polishing region and between the feed and take-up rollers, the drive rollers each comprising polishing strip clamping regions having clamps for releasably clamping a portion of the polishing strip to the drive rollers, wherein the drive rollers are configured to oscillate a length of the polishing strip across the polishing region, and wherein at least one of the take-up and feed rollers is operably connected with a motor configured to selectively rotate the at least one of the take-up and feed rollers and position a different portion of the polishing member between the pair of drive rollers.

* * * * *